US008126354B2

(12) United States Patent
Tanaka

(10) Patent No.: US 8,126,354 B2
(45) Date of Patent: Feb. 28, 2012

(54) CHARGING DEVICE, PROCESS CARTRIDGE, AND IMAGE FORMING APPARATUS

(75) Inventor: Shuji Tanaka, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 272 days.

(21) Appl. No.: 12/299,625

(22) PCT Filed: Dec. 4, 2007

(86) PCT No.: PCT/JP2007/073745

§ 371 (c)(1),
(2), (4) Date: Nov. 5, 2008

(87) PCT Pub. No.: WO2008/069339

PCT Pub. Date: Jun. 12, 2008

(65) Prior Publication Data

US 2009/0180794 A1 Jul. 16, 2009

(30) Foreign Application Priority Data

Dec. 4, 2006 (JP) ..... 2006-327044

(51) Int. Cl.
*G03G 15/02* (2006.01)

(52) U.S. Cl. ..... 399/100; 399/111; 399/115; 399/176

(58) Field of Classification Search ..... 399/98–100, 399/107, 111, 115, 168, 176, 310, 313, 314, 399/357; 428/447; 429/53, 56, 59
See application file for complete search history.

(56) References Cited

U.S. PATENT DOCUMENTS

| | | | | |
|---|---|---|---|---|
| 5,235,386 | A * | 8/1993 | Yano et al. | 399/176 |
| 6,005,687 | A | 12/1999 | Kawashima et al. | |
| 6,147,781 | A | 11/2000 | Tanaka et al. | |
| 6,182,964 | B1 | 2/2001 | Tanaka et al. | |
| 6,311,973 | B1 | 11/2001 | Tanaka et al. | |
| 6,337,962 | B1 * | 1/2002 | Inoue et al. | 399/111 |
| 6,438,331 | B2 * | 8/2002 | Sakaizawa et al. | 399/50 |
| 6,763,216 | B2 | 7/2004 | Ishibashi et al. | |
| 7,664,434 | B2 * | 2/2010 | Kuroda et al. | 399/176 |
| 2005/0191081 | A1 | 9/2005 | Muraishi et al. | |
| 2005/0265749 | A1 | 12/2005 | Asanuma et al. | |
| 2006/0067727 | A1 | 3/2006 | Suda et al. | |
| 2007/0059067 | A1 | 3/2007 | Tanaka et al. | |
| 2007/0081832 | A1 | 4/2007 | Yoshida et al. | |
| 2007/0147884 | A1 | 6/2007 | Tanaka | |

(Continued)

FOREIGN PATENT DOCUMENTS

JP 3 130787 6/1991

(Continued)

OTHER PUBLICATIONS

Extended Search Report issued Apr. 5, 2011 in Europe Application No. 07850319.0.

*Primary Examiner* — Hoan Tran
(74) *Attorney, Agent, or Firm* — Oblon, Spivak, McClelland, Maier & Neustadt, L.L.P.

(57) ABSTRACT

A charging device includes a charging roller and a cleaning roller configured to make contact with the charging roller. The cleaning roller is rotated following the charging roller. A dynamic friction coefficient of a surface of the charging roller measured by a Euler belt method is equal to or larger than 0.5.

14 Claims, 5 Drawing Sheets

U.S. PATENT DOCUMENTS

| | | | |
|---|---|---|---|
| 2007/0172273 | A1 | 7/2007 | Harada et al. |
| 2007/0183824 | A1 | 8/2007 | Suda et al. |
| 2008/0013998 | A1 | 1/2008 | Kumagai et al. |
| 2009/0087213 | A1 | 4/2009 | Takaya et al. |

FOREIGN PATENT DOCUMENTS

| | | |
|---|---|---|
| JP | 6-130780 | 5/1994 |
| JP | 7-140762 | 6/1995 |
| JP | 8 95350 | 4/1996 |
| JP | 8 110683 | 4/1996 |
| JP | 2853208 | 11/1998 |
| JP | 3317748 | 6/2002 |
| JP | 2004 251974 | 9/2004 |
| JP | 2006 3593 | 1/2006 |
| JP | 2006 30978 | 2/2006 |
| JP | 2006 64953 | 3/2006 |
| JP | 2006 78726 | 3/2006 |
| KR | 10-0615503 | 8/2006 |

* cited by examiner $$SF1 = \frac{(MXLNG)^2}{AREA} \times \frac{\pi}{4} \times 100$$

$$SF2 = \frac{(PERI)^2}{AREA} \times \frac{1}{4\pi} \times 100$$

CHARGING DEVICE, PROCESS CARTRIDGE, AND IMAGE FORMING APPARATUS

TECHNICAL FIELD

The present invention relates to a charging device, a process cartridge, and an electrophotographic image forming apparatus such as a copier, a printer, and a facsimile machine.

BACKGROUND ART

A recent electrophotographic image forming apparatus has been expected to be durable even from a viewpoint of the reduction of environmental burdens. One of the factors hampering the expected durability is degradation of an image due to a stain on a charging roller.

The charging roller is mainly employed as a charging unit in the electrophotographic image forming apparatus. To achieve a high image quality, in most cases, a photosensitive element is charged by superimposing a direct current and an alternate current, and applying the superimposed current to the charging roller.

Conventionally, there has been developed various technologies for protecting the charging roller from being stained. As for the development of the charging roller itself, for example, a surface roughness and a friction coefficient of the charging roller are reduced, and thereby preventing the charging roller from being stained with a toner or the like.

As for the development of a cleaning member for cleaning the charging roller, for example, according to a conventional technology disclosed in Japanese Patent Application Laid-open No. 2004-251974, a brush roller is provided to clean a surface of the charging roller, and a surface roughness of the charging roller is set to be 25 μm or less, and thereby preventing the charging roller from being stained with a foreign substance including the toner. However, only the setting of the surface roughness of the charging roller is not enough to prevent the charging roller from being stained with the foreign substance, so that it is not possible to achieve a sufficient durability.

According to a conventional technology disclosed in Japanese Patent Application Laid-open No. 2006-64953, a sheet-like stain-resistant member is arranged to have contact with the charging roller, and a surface roughness of a surface of the sheet-like stain-resistant member is set to be larger than that of the surface of the charging roller. However, with this configuration, the stain-resistant member slidingly moves with being rubbed against the surface of the charging roller, so that a stain on the charging roller is stuck when the charging roller is used for a long time, and thereby making it difficult to achieve a sufficient durability.

According to a conventional technology disclosed in Japanese Patent No. 3317748, it is configured that a contact pressure $P_1$ between a charging roller and a photosensitive drum is larger than a contact pressure $P_2$ between the charging roller and a cleaning blade, a friction coefficient $\mu_1$ between the charging roller and the photosensitive drum is smaller than a friction coefficient $\mu_2$ between the charging roller and the cleaning blade, and a rubber hardness of the charging roller is larger than that of the cleaning blade. With this configuration, the cleaning blade slidingly moves with being rubbed against the surface of the charging roller, so that a stain on the charging roller is stuck when the charging roller is used for a long time, and thereby making it difficult to achieve a sufficient durability, in the same manner as the technology disclosed in Japanese Patent Application Laid-open No. 2006-64953.

In this manner, by providing the cleaning roller, it is possible to slow a rate of getting the charging roller stained, i.e., it is possible to extend a life span of the image forming apparatus. However, it was found that once an additive agent of the scraped toner, the toner, a lubricant, and the like adhered on the cleaning roller are saturated, they are rubbed into the surface of the charging roller due to a slight slipping between the cleaning roller and the charging roller. Therefore, it is necessary to develop a configuration capable of preventing a slipping between the cleaning roller and the charging roller.

An object of the present invention is to prevent an occurrence of the degradation of an image due to "a stain on the charging roller", as one of the factors hampering a sufficient durability of the image forming apparatus. In other words, an object of the present invention is to improve a cleaning effect on the charging roller.

DISCLOSURE OF INVENTION

To solve the problems, a charging device according to the present invention includes a charging roller and a cleaning roller configured to make contact with the charging roller. The cleaning roller is rotated following the charging roller. A dynamic friction coefficient of a surface of the charging roller measured by a Euler belt method is 0.5 or more.

Furthermore, it is more effective that a pressure applied to the cleaning roller to be biased is larger than a weight of the cleaning roller, and smaller than 4 N. A surface roughness of the charging roller is preferred to be 2.5 μm or less. It is more preferable that a dynamic friction coefficient of the charging roller is smaller than a dynamic friction coefficient of the cleaning roller. It is also preferable that the cleaning roller is made of a melamine resin.

BEST MODE(S) FOR CARRYING OUT THE INVENTION

Exemplary embodiments of an image forming apparatus according to the present invention are explained in detail below with reference to accompanying drawings.

Figure 1:
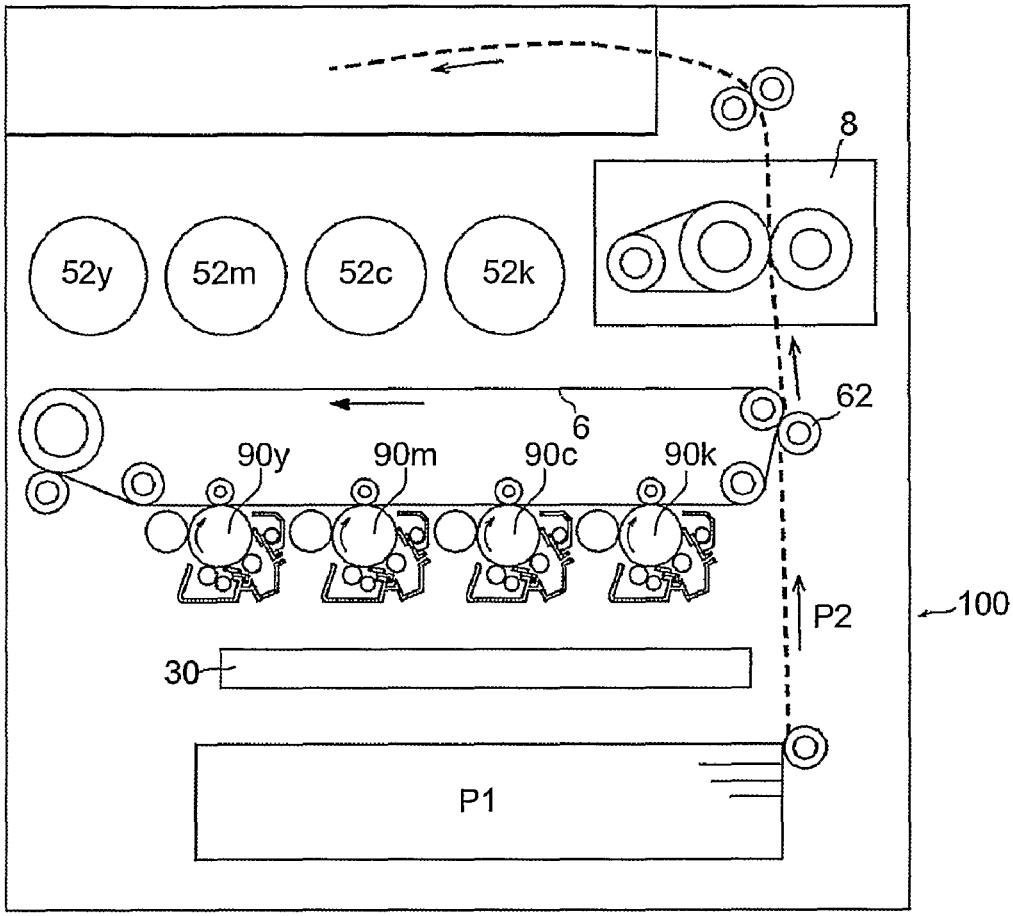
FIG. 1 is a schematic diagram of an image forming apparatus employing an intermediate transfer method according to an embodiment of the present invention.

FIG. 1 is a schematic diagram of an image forming apparatus 100 employing an intermediate transfer method according to an embodiment of the present invention. As shown in FIG. 1, the image forming apparatus 100 includes process cartridges 90*y*, 90*m*, 90*c*, and 90*k*, an exposure unit 30, an intermediate transfer belt 6, a sheet containing unit P1, a sheet conveying unit P2, a secondary transfer unit 62, a fixing unit 8, toner containers 52*y*, 52*m*, 52*c*, and 52*k*, an image processing unit (not shown), and the like. The process cartridges 90*y*, 90*m*, 90*c*, and 90*k* form a toner image for yellow (y), magenta (m), cyan (c), and black (k) colors, respectively. The intermediate transfer belt 6 conveys the y, m, c, and k toner images superimposed thereon. The sheet containing unit P1 contains therein a recording medium. The recording medium is conveyed from the sheet containing unit P1 by the sheet conveying unit P2. The secondary transfer unit 62 transfers the toner images on the intermediate transfer belt 6 onto the recording medium. The fixing unit 8 includes a heating unit that fixes the unfixed toner images on the recording medium by the application of heat with a belt or the like. The toner containers 52*y*, 52*m*, 52*c*, and 52*k* contain therein unused y, m, c, and k toners, respectively.

The process cartridge is explained below with reference to FIG. 2. Each of the process cartridges 90 ("y", "m", "c", or "k" indicating a toner color is omitted to be simplified) includes a photosensitive member 1 as an image carrier, a charging roller 2, a developing unit 4, a cleaning blade 7, a brush roller 9, and the like. The cleaning blade 7 is used to scrape out transfer residual toners from the photosensitive member 1 after the toner images are transferred onto the intermediate transfer belt 6. The brush roller 9 is used to apply a lubricant to a surface of the photosensitive member 1. By the application of the lubricant, a friction coefficient of the surface of the photosensitive member 1 can be stabilized at a low level. Generally, the process cartridge indicates a cartridge in which the image carrier and at least a developing roller as the developing unit are integrally contained, and the process cartridge is removably attached to a main body of the image forming apparatus.

As a charging method, there are a scorotron charging method with a wire, a corotron charging method, a contact roller charging method with a mid-resistance rubber roller, and a non-contact roller charging method (in the present embodiment, the contact roller charging method is employed). The scorotron charging method used to be employed when the surface of the photosensitive member is charged negatively. However, ozone is generated at the time of discharging, so that currently, the scorotron charging method is rarely employed except for a limited model group from a viewpoint of environmental concerns. The corotron charging method is employed when the surface of the photosensitive member is charged positively, and the ozone is not generated so much. However, the corotron charging method is not commonly employed. Recently, as the charging method, the contact roller charging method is most commonly employed because it is possible to prevent a generation of an ozone and a unit cost of a roller is getting reduced. Both the contact roller charging method and the non-contact roller charging method have a method in which an alternate current is superimposed on a direct current and a method in which only a direct current is applied to a roller.

In a case of the non-contact roller charging method, when an alternate current is controlled to be output at a constant current, an image is unevenly formed due to a change in a gap between the photosensitive member 1 and the charging roller 2. Therefore, it is necessary to provide a unit for correcting an applied voltage in the same manner as a case in which only a direct current is applied. However, the non-contact roller charging method can reduce a degree of a stain on the charging roller as compared with the contact roller charging method because of the non-contact method. As a method of correcting an applied voltage, there are some methods, such as a method of switching an applied voltage by a detection of a temperature near the charging roller, a method of switching an applied voltage by a detection of scumming on the photosensitive member at regular intervals, a method of determining an applied voltage depending on a feedback current, and the like. With any of the methods, the surface of the photosensitive member is charged at approximately −500V to −700V.

In a case of the contact roller charging method, when an alternate current is superimposed on a direct current, a higher image quality can be obtained as compared with a case in which only a direct current is applied. However, it is necessary to care about toner filming on the photosensitive member. By controlling the alternate current to be output at a constant current, a surface potential is not affected by a change in a resistance value of the charging roller due to environmental changes. However, there are problems of a high cost of a high-voltage power supply and a noise of a high-frequency alternate current. In the case in which only a direct current is applied, a surface potential is affected by a change in a resistance value of the charging roller due to environmental changes. Therefore, it is necessary to provide any unit for correcting an applied voltage.

As a method of driving the charging roller 2 to rotate, for example, there are following two methods. As the first method, by having contact with the photosensitive member 1, the charging roller 2 is rotated by the action of a frictional force between them. As the second method, the charging roller 2 is rotated by the use of a driving force of a photosensitive member gear or the like. In a low-speed apparatus, the first method is employed in most cases. Conversely, in an apparatus required to achieve a high-speed and a high image quality, the second method is employed in most cases.

An image forming process is explained below with reference to FIGS. 1 and 2. When the image forming apparatus receives an image output instruction from an input device (not shown) such as a personal computer (PC) or a scanner, an image signal is decomposed into image signals for y, m, c, and k colors by the image processing unit, and the image signals are output to the exposure unit 30. The exposure unit 30 employs, for example, a laser-scanning exposure method with a laser light source and a polygon mirror. In each of the process cartridges 90, the photosensitive member 1 is driven to rotate, and uniformly charged by the charging roller 2. After that, when the photosensitive member 1 is exposed by the exposure unit 30 depending on each of the image signals, an electrostatic latent image is formed on the photosensitive member 1. The electrostatic latent image is developed into a toner image by the developing unit 4. The toner image on the photosensitive member 1 is transferred onto the intermediate transfer belt 6 by the application of a bias to a transfer roller 61. After the toner image is transferred onto the intermediate transfer belt 6, a transfer residual toner remained on the photosensitive member 1 is removed by the cleaning blade 7 in which a polyurethane rubber of the cleaning blade 7 has contact with the photosensitive member 1 in a counter direction. The removed transfer residual toner is conveyed by a waste-toner collecting coil 10 to be contained in a waste toner tank (not shown). Each of the developing units 4 is refilled with a toner corresponding to the consumed toner from each of the toner containers 52 by each of toner refilling units (not shown). The y, m, c, and k toner images are sequentially transferred onto the intermediate transfer belt 6 to be superimposed thereon by the process cartridges 90*y*, 90*m*, 90*c*, and 90*k*, respectively. A recording medium is conveyed, for example, from the sheet containing unit P1 to the secondary transfer unit 62 via the sheet conveying unit P2. The superimposed toner images on the intermediate transfer belt 6 are transferred onto the recording medium by the secondary transfer unit 62. The recording medium on which the unfixed toner images are transferred is conveyed to the fixing unit 8. The unfixed toner images are fused and fixed on the recording medium by the application of heat and pressure by the fixing unit 8. Then, the recording medium is ejected from the image forming apparatus 100, and the image forming process is terminated.

Subsequently, a stain on the charging roller 2 is explained below. When a surface of the charging roller 2 is stained, a charging performance of a stained portion of the charging roller 2 is degraded, and thus the photosensitive member 1 cannot be charged to a target potential. Consequently, degradation of an image occurs due to the charging failure. To prevent such the problem, a cleaning roller 11 as a charging-roller cleaning unit is provided. The cleaning roller 11 is arranged to have contact with the charging roller 2. As the cleaning roller 11, it is possible to use any of an electrostatic flocking brush in which fibers are electrostatically flocked around a metal shaft of the brush, a melamine roller in which a metal shaft of the roller is coated with a melamine resin, and the like. In the present circumstances, the melamine roller is preferred to be used to achieve the durability.

When a slipping occurs between the cleaning roller 11 and the charging roller 2, a stain on the charging roller 2 is rubbed into the surface of the charging roller 2, and thereby accelerating an occurrence rate of the degradation of an image due to the stain. Therefore, it is configured that the cleaning roller 11 is not driven to rotate, but the cleaning roller 11 is rotated by a rotation transmission from the charging roller 2 so as to remove a stain on the surface of the charging roller 2. If the cleaning roller 11 is driven to rotate, a slipping definitely occurs between the cleaning roller 11 and the charging roller 2 due to diameter tolerances of the charging roller 2 and the cleaning roller 11, and thereby decreasing the durability. It is preferable that rates of surface movement in contact portions of the charging roller 2 and the cleaning roller 11 are identical to each other (in this case, no slipping occurs).

Figure 2:
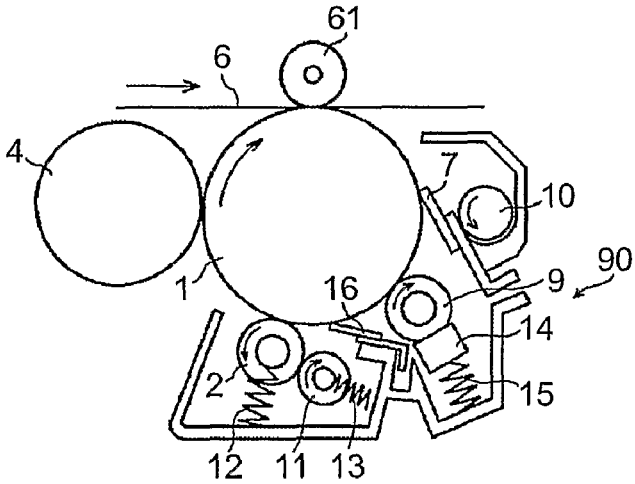
FIG. 2 is a schematic diagram of a process cartridge included in the image forming apparatus shown in FIG. 1.
Figure 3:
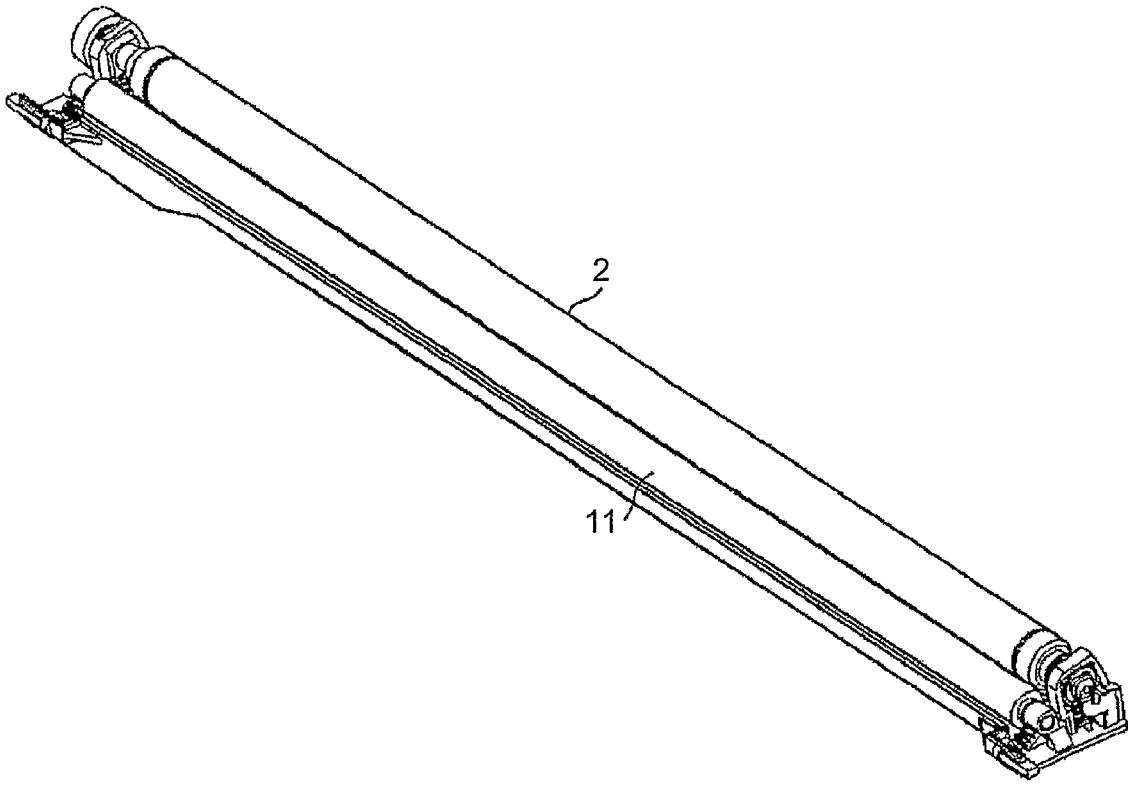
FIG. 3 is a perspective view of a charging roller and a cleaning roller those included in the process cartridge shown in FIG. 2.
Figure 4:
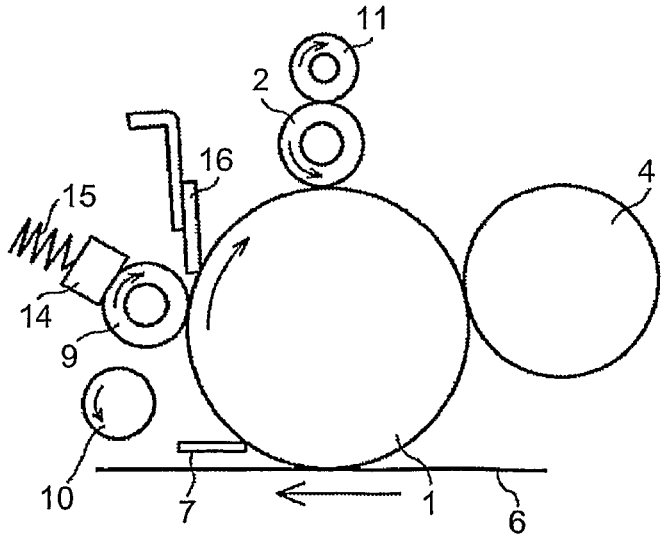
FIG. 4 is a schematic diagram of a process cartridge having a configuration different from that is shown in FIG. 2.

In the process cartridge 90 shown in FIG. 2, a pressure spring 12 for pressurizing the charging roller 2 and a pressure spring 13 for pressurizing the cleaning roller 11 are provided so that an obliquely downward portion of the charging roller 2 has contact with the cleaning roller 11. FIG. 3 depicts the charging roller 2 and the cleaning roller 11 viewed from a different angle. FIG. 4 is a schematic diagram of a process cartridge having a configuration different from that is shown in FIG. 2. In the process cartridge shown in FIG. 4, the cleaning roller 11 is arranged on top of the charging roller 2 with having contact with the charging roller 2, so that it is not necessary to provide the pressure springs 12 and 13 because the cleaning roller 11 can have contact with the charging roller 2 with its own weight.

To prevent the toner filming on the photosensitive member 1, a lubricant 14 is applied to the surface of the photosensitive member 1. The lubricant 14 is pressurized to have contact with the brush roller 9 by the action of a pressure spring 15. In accordance with a rotation of the brush roller 9, the lubricant 14 is gradually scraped off by the brush roller 9, and the scraped lubricant on the brush roller 9 is applied to the surface of the photosensitive member 1. The lubricant applied to the surface of the photosensitive member 1 by the brush roller 9 is fixed on the surface of the photosensitive member 1 at an even thickness by a lubricant applying blade 16. As the lubricant, ZnSt (zinc stearate) is most commonly used. As a material of the brush roller 9, for example, an insulated PET, a conductive PET, or an acrylic fiber is used.

Figure 5:
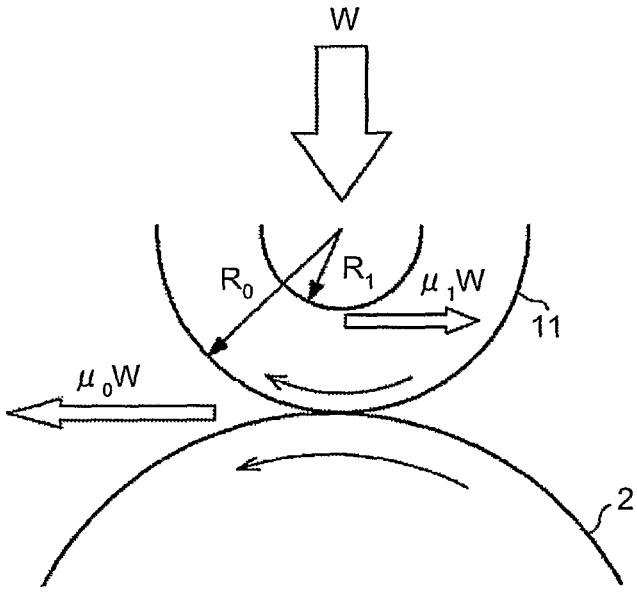
FIG. 5 is a schematic diagram for explaining a condition for establishing that the cleaning roller is rotated by a rotation transmission from the charging roller.

A condition for establishing that the cleaning roller 11 is rotated by the rotation transmission from the charging roller 2 is explained below with reference to FIG. 5. The condition is expressed by $$\mu_0 W \times R_0 > \mu_1 W \times R_1 \quad (1)$$

where $\mu_0$ is a static friction coefficient between the charging roller and the cleaning roller, $\mu_1$ is a static friction coefficient between the cleaning roller and a bearing (a shaft supporting unit), W is a pressure (including a weight of the cleaning roller), $R_1$ is a radius of the bearing, and $R_0$ is a radius of the cleaning roller.

In theory, the condition is expressed in Inequality (1). However, practically, when a pressure is substantially small, a shaft of the cleaning roller slightly touches on the bearing (the shaft supporting unit), so that a value of $\mu_1 W$ is vanishingly small. When the pressure increases, and the shaft of the cleaning roller has contact with the bearing (the shaft supporting unit) properly, a frictional force generated in contact portions of the shaft of the cleaning roller and the bearing (the shaft supporting unit) becomes a load, so that the cleaning roller 11 cannot be rotated by the rotation transmission from the charging roller 2, and thereby causing an occurrence of a slipping between the charging roller 2 and the cleaning roller 11. On the other hand, if the pressure is excessively small, the cleaning roller 11 does not have contact with the charging roller 2 dynamically in a proper manner, so that the cleaning roller 11 rotates with having contact with the charging roller 2 and moving away from the charging roller 2 repeatedly (in a stick-and-slip state) in accordance with a rotation of the charging roller 2. By the stick-and-slip motion, the surface of the charging roller 2 is rubbed, and a stain on the charging roller 2 is rubbed thereinto.

A table 1 indicates a result of an experiment for determining whether degradation of an image occurs due to a stain on the charging roller 2. In a column of a cleaning effect in the drawing, a field marked with "○" denotes no occurrence of the degradation of an image due to a stain on the charging roller 2.

TABLE 1

| Cleaning roller | | Charging roller | | | |
|---|---|---|---|---|---|
| Rotation system | Pressure to charging roller | Surface roughness | Friction coefficient | Cleaning effect | Charge uniformity |
| With driving force | Controlled by nip amount not pressure | 3 μm or more | 0.2 or less | x | — |

TABLE 1-continued

| Cleaning roller | | Charging roller | | | |
|---|---|---|---|---|---|
| Rotation system | Pressure to charging roller | Surface roughness | Friction coefficient | Cleaning effect | Charge uniformity |
| By rotation transmission from charging roller | 1 N | 3 μm or more | 0.2 or less | Δ | ○ |
| By rotation transmission from charging roller | 4 N | 3 μm or more | 0.2 or less | x | — |
| By rotation transmission from charging roller | 1 N | 2.5 μm or less | 0.5 or more | ○ | ○ |
| By rotation transmission from charging roller | 4 N | 2.5 μm or less | 0.5 or more | ○ | ○ |

According to the experiment, an excellent result was obtained under following conditions:

The cleaning roller is rotated by the rotation transmission from the charging roller;

| | |
|---|---|
| Pressure | 1 N to 4 N; |
| Surface roughness (Rz) | 2.5 μm or less; and |
| Friction coefficient | 0.5 or more. |

Figure 6:
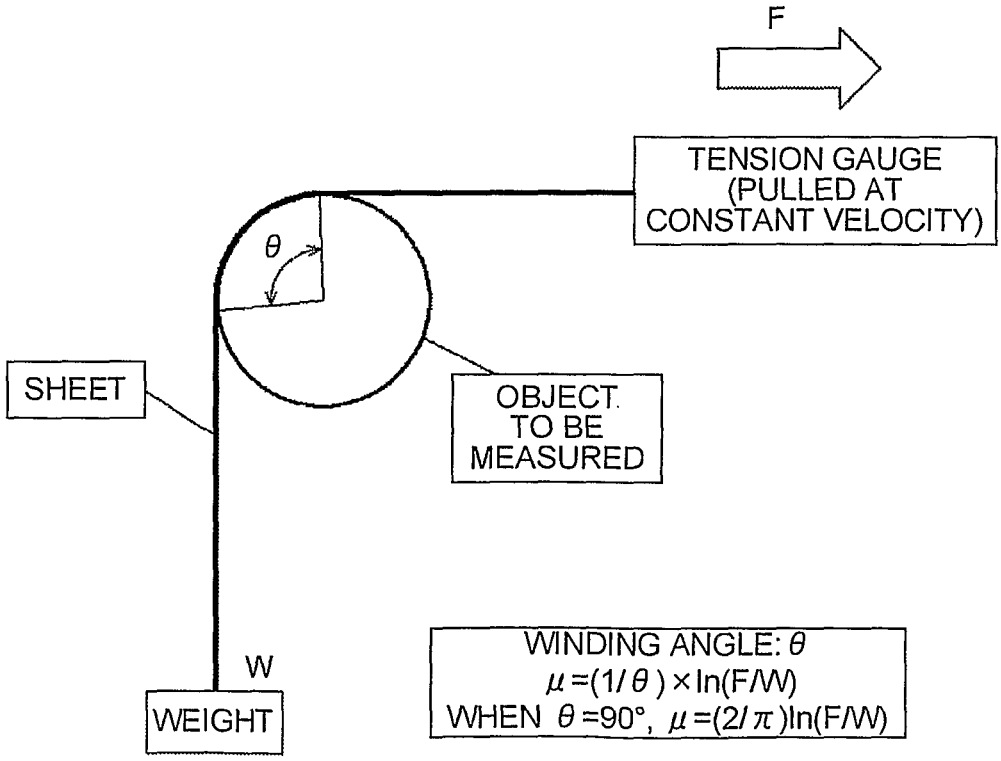
FIG. 6 is an explanatory diagram of a Euler belt method.

A method of measuring a friction coefficient with a Euler belt method is explained below with reference to FIG. 6. A sheet-like substance is arranged to have a winding angle θ with respect to a roller as an object to be measured. A weight is added to one end of the sheet-like substance, and the other end of the sheet-like substance is pulled at a constant velocity with a tension gauge. Based on a value of the tension gauge, the friction coefficient is obtained by $$\mu=(1/\theta)\times\ln(F/W) \quad (2)$$

In the experiment, the measurement was carried out under following conditions:

| | |
|---|---|
| Sheet material | Paper; and |
| W | 100 gf. |

A value obtained by the above method is referred to as a dynamic friction coefficient.

Subsequently, characteristics of a toner preferred to be used in the image forming apparatus according to the present invention are explained below. To reproduce a microdot image at 600 dpi or more stably, a weight-average particle diameter of the toner is preferred to be in a range of 3 μm to 8 μm. Within the range, a particle diameter of the toner is sufficiently small to reproduce a microdot latent image, so that the dot reproducibility can be improved. On the other hand, when the weight-average particle diameter (D4) of the toner is 3 μm or less, such phenomena as decreases of the transfer efficiency and the blade cleaning effect easily occur. When the weight-average particle diameter of the toner (D4) exceeds 8 μm, a pile height of an image increases, and thus it is difficult to prevent a blur of a character or a line.

At the same time, a ratio (D4/D1) of the weight-average particle diameter (D4) to a number-average particle diameter (D1) is preferred to be in a range of 1.00 to 1.40. As the ratio (D4/D1) is closer to 1.00, a particle-size distribution is getting sharpened. When the toner has such a small particle size and such a narrow particle-size distribution, a toner charge distribution becomes homogeneous. Therefore, it is possible to obtain a high-quality image with few background defects. Moreover, in a case of an electrostatic image transfer method, it is possible to increase the transferability.

Subsequently, a method of measuring a particle-size distribution of toner particles is explained. As an apparatus for measuring a particle-size distribution of toner particles with a Coulter counter method, for example, there are a Coulter Counter TA-II and a Coulter Multisizer II (both manufactured by Coulter, Inc.). The measuring method is explained below. First, 0.1 ml to 5 ml of a surfactant agent (preferably, an alkylbenzene sulfonate) as a dispersant is added to an electrolytic solution of 100 ml to 150 ml. The electrolytic solution is made by preparing an approximately 1% NaCl solution with a primary sodium chloride. For example, an Isoton-II (manufactured by Coulter, Inc.) can be used as the electrolytic solution. Then, a measurement sample of 2 mg to 20 mg is added to the electrolytic solution. The electrolytic solution in which the sample is suspended is dispersed by an ultrasonic disperser for about one to three minutes. After that, a weight distribution and a number distribution are obtained by measuring a weight of a toner particle or a toner and the number of toner particles or toners with an aperture of 100 μm. Based on the obtained distributions, the weight-average particle diameter (D4) and the number-average particle diameter (D1) of the toner can be obtained.

Subject channels to be used are following ranges of thirteen channels: 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; and 32.00 μm to less than 40.30 μm, and particles having a particle diameter in a range of 2.00 μm to less than 40.30 μm are to be used.

Figure 7:
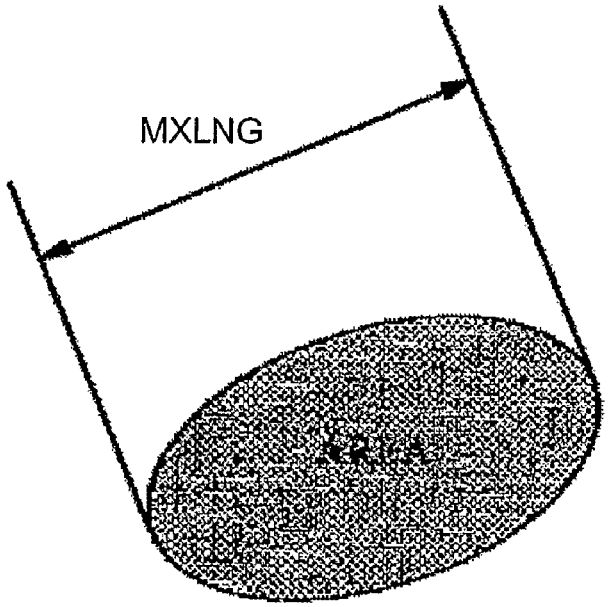
FIG. 7 is a schematic diagram for explaining a shape of a toner having a shape factor SF-1.
Figure 8:
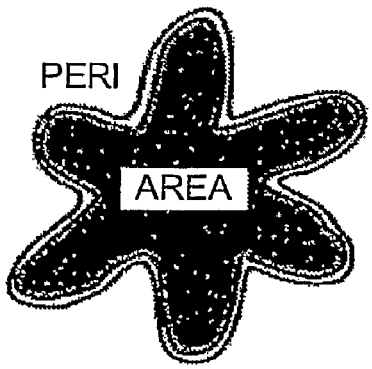
FIG. 8 is a schematic diagram for explaining a shape of a toner having a shape factor SF-2.

It is preferable to set shape factor SF-1 of toner in a range between 100 to 180, while a shape factor SF-2 in a range between 100 and 180. FIGS. 7 and 8 are schematic diagrams for explaining the shape factors SF-1 and SF-2 of the toner to be used in the image forming apparatus 100.

The shape factor SF-1 indicates roundness of the toner, as defined by Equation (3). In other words, the shape factor SF-1 is a value obtained by dividing square of maximum length (MXLNG) of a shape of toner projected on a two-dimensional plane by an area (AREA) of the shape, and then by multiplying 100π/4.

$$SF\text{-}1=\{(MXLNG)2/AREA\}\times(100\pi/4) \quad (3)$$

When SF-1 equals to 100, the toner is a perfect sphere, and as SF-1 increases, the shape of the toner becomes more infinite.

The shape factor SF-2 indicates irregularity of the toner, as defined by Equation (4). In other words, the shape factor SF-2 is a value obtained by dividing square of perimeter (PERI) of a shape of toner projected on a two-dimensional plane by an area (AREA) of the shape, and then by multiplying 100π/4.

$$SF\text{-}2=\{(PERI)2/AREA\}\times(100\pi/4) \quad (4)$$

When SF-2 equals to 100, irregularity is not present on the surface of the toner, and as SF-2 increases, the irregularity of the surface of the toner increases.

The shape factors are measured by taking photographs of toner by using a scanning electron microscope (S-800, Hitachi, Ltd.), and by analyzing and calculating taken photographs by using an image analyzer (LUSEX3, Nireko, Ltd.). As the shape of the toner becomes closer to sphere, toners make point contacts with each other, or toner and photosensitive drum make point contact with each other, so that absorbability between the toners decreases, increasing flowability of the toner. Furthermore, the absorbability between the toner and the photosensitive drum decreases, resulting in increasing transferability. When one of SF-1 and SF-2 exceeds 180, transferability decreases, which is not preferable.

In the toner according to the present embodiment, microparticles having an average primary particle diameter in a range of 50 nm to 500 nm and a bulk density of 0.3 mg/cm$^3$ or more (hereinafter, "microparticles") are adhered to surfaces of the toner particles. With the use of the microparticles as an additive agent, it is possible to improve the cleaning effect. Particularly, when the toner having a small particle diameter capable of achieving a high image quality is used, it is also possible to improve the developing performance and the transferability. Incidentally, as a flow improver, for example, silica is commonly used. Generally, an average primary particle diameter of the silica is in a range of 10 nm to 30 nm, and a bulk density of the silica is in a range of 0.1 mg/cm$^3$ to 0.2 mg/cm$^3$.

By adhering the microparticles having appropriate characteristics to the surface of the toner, an adequate void is formed between the toner particles and a subject material. Contact areas of the microparticles with respect to the toner particles, the photosensitive member, and a charge applying member are very small, so that the microparticles have contact with the toner particles, the photosensitive member, and the charge applying member uniformly. Therefore, it is possible to reduce the adherence efficiently and also to improve the developing performance and the transfer efficiency effectively. Furthermore, the microparticles serve as a roller, so that the photosensitive member can be prevented from being worn or damaged. When the photosensitive member is cleaned in a condition of a high stress (such as a high load or a high speed) between the cleaning blade and the photosensitive member, the microparticles are not easily buried between the toner particles. Even when some of the microparticles are buried between the toner particles, the microparticles can get out from between the toner particles, and return back to an original state. Therefore, with the microparticles, the toner can stably keep the characteristics for a long time. Furthermore, the microparticles are moderately desorbed from the surface of the toner, and accumulated in a tip portion of the cleaning blade. As a result, the microparticles accumulated in the tip portion act as a barrier, so-called a dam effect, and thereby preventing the toner from fitting through the blade. With such the characteristics, a share of the toner particles is reduced, so that it is possible to reduce the filming of the toner itself due to low rheologic elements contained in the toner for high-speed fixing (low-energy fixing). Particularly, when microparticles having an average primary particle diameter in a range of 50 μm to 500 μm are used in the toner, it is possible to exert the excellent cleaning effect sufficiently, and also not to decrease the powder flowability of the toner because a particle diameter of the microparticles is extremely small. Furthermore, although the details are not sure, when surface-treated microparticles are externally added to the toner, a rate of a degradation of a developer can be lowered even if a carrier is contaminated.

As described above, the microparticles having an average primary particle diameter (hereinafter, "an average particle diameter") in the range of 50 nm to 500 nm are used. Particularly, the average particle diameter is preferred to be in a range of 100 nm to 400 nm. If the average particle diameter is below 50 nm, the microparticles are buried in concave portions of the toner surface, so that it is not possible to reduce the adherence. On the other hand, if the average particle diameter exceeds 500 nm, the microparticles respectively have the same level of a contact area as that of the toner itself, so that it is not possible to reduce the adherence and the stress, and it is not possible to improve the transferability. If the bulk density of the microparticles is less than 0.3 mg/cm$^3$, it is possible to contribute to the improvement of the flowability, but it is not possible to reduce the adherence because the scattering level and the adherence of the toner and the microparticles increase.

As microparticles, examples of inorganic compounds include $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrO_2$, $CaO.SiO_2$, $K_2O(TiO_2)_n$, $Al_2O_3.2SiO_2$, $CaCO_3$, $MgCO_3$, $BaSO_4$, $MgSO_4$, and $SrTiO_3$. Among these, $SiO_2$, $TiO_2$, and $Al_2O_3$ are preferable. The above inorganic compounds can be hydrophobized with a coupling agent, hexamethyldisilazane, dimethyldichlorosilane, octyltriethoxysilane, or the like.

As organic compound-based microparticles, either a thermoplastic resin or a thermoset resin can be used. For example, there are vinyl resin, polyurethane resin, epoxy resin, polyester resin, polyamide resin, polyimide resin, silicone resin, phenol resin, melamine resin, urea resin, aniline resin, ionomer resin, and polycarbonate resin. As resin microparticles, a combination of two or more resins out of the above resins can afford to be used. Particularly, aqueous dispersion of spherical micro resin particles and a combination of these resins are preferred to be used because it is easy to obtain vinyl resin, polyurethane resin, epoxy resin, and polyester resin.

As concrete examples of vinyl resins, there are polymer that vinyl monomer is homopolymerized or copolymerized, for example, styrene-ester (meth)acrylate copolymer, styrene butadiene copolymer, (meth)acrylate-ester acrylate copolymer, styrene acrylonitrile copolymer, styrene maleic anhydride copolymer, and styrene (meth) acrylate copolymer.

The bulk density of the microparticles is measured with a measuring cylinder for 100 ml in such a manner that the microparticles are gradually added into the measuring cylinder to fill the measuring cylinder with the microparticles. At this time, it is configured not to produce any vibration in the measuring cylinder. The bulk density is measured based on a difference between weights of the measuring cylinder before and after the microparticles are added thereinto.

Bulk density ($mg/cm^3$)=Microparticle weight (g/100 ml)/100

As a method of externally-adding the microparticles according to the present invention to the surface of the toner, for example, toner base particles and microparticles are mechanically-mixed by a commonly-used mixing device to adhere to each other, or toner base particles and microparticles are uniformly dispersed in a solution phase with a surfactant agent or the like and processed to be adhered to each other, and then dried.

The toner characteristics relating to the toner fixability are well known to those skilled in the art, and particularly, it is known that the toner fixability is related to a ½ outflow temperature (a softening point). However, according to the present invention, any relation between the ½ outflow temperature (the softening point) and the fixability was not seen. When a toner meeting such toner characteristics that a glass transition temperature is in a range of 45° C. to 65° C. and an outflow start temperature is in a range of 90° C. to 115° C. was used, it was found that the excellent fixability can be obtained. When the glass transition temperature is below 45° C., an offset may occur at the time of fixing. On the other hand, when the glass transition temperature exceeds 65° C., the sufficient fixability cannot be obtained, so that an image may easily come off from a transfer medium. When the outflow start temperature is below 90° C., an offset may occur at the time of fixing. On the other hand, when the outflow start temperature exceeds 115° C., the sufficient fixability cannot be obtained, so that an image may easily come off from a transfer medium.

A method of measuring a glass transition point ($T_g$) is briefly explained below. As a device for measuring the $T_g$, a TG-DSC system TAS-100 manufactured by Rigaku Denki Co., Ltd. was used. First, about 10 mg of a sample is added into an aluminum sample container, and the sample container is put in a holder unit. The holder unit is set in an electric furnace. After the sample is heated from a room temperature to 150° C. at a rate of a rising temperature of 10° C./min to be at 150° C., the sample is left at 150° C. for 10 minutes. Then, the sample is cooled down to the room temperature, and left for 10 minutes. The sample is again heated in a nitrogen atmosphere up to 150° C. at the rate of the rising temperature of 10° C./min, and a DSC measurement was carried out. The $T_g$ was obtained from a point of contact between a tangent of an endothermic curve near the $T_g$ and a base line by an analysis system included in the TAS-100 system.

Figure 9A:
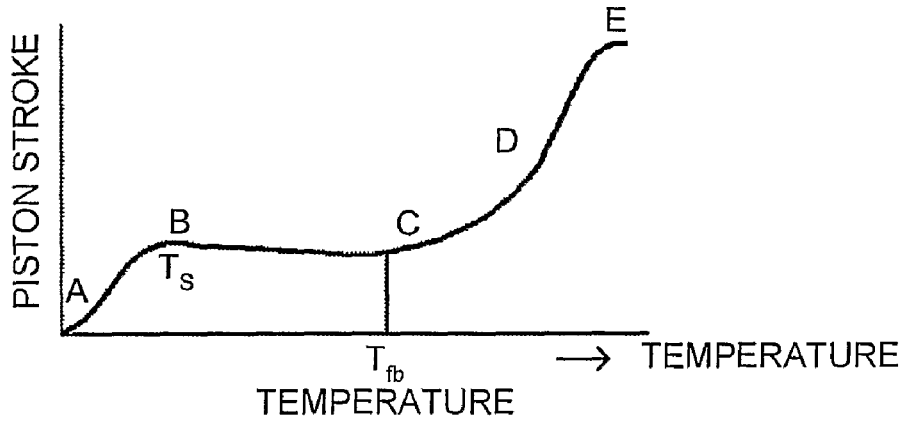
FIG. 9A is a graph obtained by a flow tester that measures an outflow start temperature of the toner.
Figure 9B:
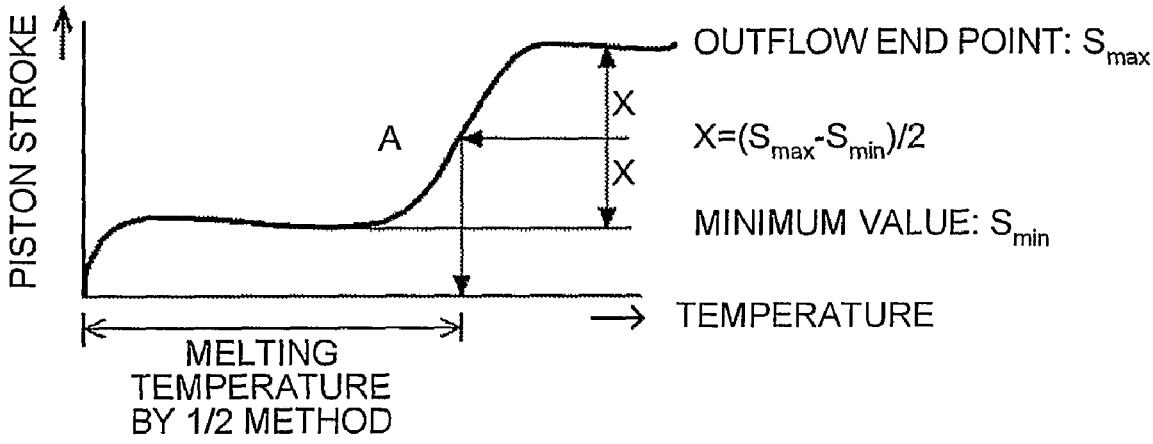
FIG. 9B is a graph obtained by a flow tester that measures an outflow start temperature of the toner.

The outflow start temperature of the toner can be measured with a flow tester. As the flow tester, for example, an elevated flow tester CFT500D manufactured by Shimadzu Seisakusho Co., Ltd. can be used. FIGS. 9A and 9B are graphs obtained by the flow tester that measures an outflow start temperature of the toner. In the drawings, a temperature $T_{fb}$ denotes the outflow start temperature, and a melting temperature in a ½ method denotes a temperature T½. Conditions for the measurement are:

| | |
|---|---|
| Load | 5 $kg/cm^2$; |
| Rate of rising temperature | 3.0° C./min; |
| Bore diameter of die | 1.00 mm; and |
| Length of die | 10.0 mm. |

As a binder resin used in the toner according to the present invention, as long as the toner characteristics according to the present invention are fulfilled, it is possible to use any of resins having following compositions. Examples of the binder resin include styrene such as polyester, polystyrene, poly-p-chlorostyrene, polyvinyltoluene, and substituted homopolymer thereof; a styrene copolymer such as styrene-p-chlorostyrene copolymer, styrene propylene copolymer, styrene vinyltoluene copolymer, styrene vinylnaphthalene copolymer, styrene methyl acrylate copolymer, styrene ethyl acrylate copolymer, styrene butyl acrylate copolymer, styrene octyl acrylate copolymer, styrene methyl methacrylate copolymer, styrene ethyl methacrylate copolymer, styrene butyl methacrylate copolymer, styrene-α-methyl chloromethacrylate copolymer, styrene acrylonitrile copolymer, styrene vinylmethylether copolymer, styrene vinylethylether copolymer, styrene vinylmethylketone copolymer, styrene butadiene copolymer, styrene isoprene copolymer, styrene acrylonitrile indene copolymer, styrene maleate copolymer, styrene ester maleate copolymer.

In addition, the following resin can be used by mixture. Examples of the resin include polymethyl methacrylate, polybutyl methacrylate, polychloro vinyl, polyacetic vinyl, polyethylene, polypropylene, polyurethane, polyamide, epoxy resin, polyvinylbutyral, polyacrylic resin, rodine, modified rodine, terpene resin, phenol resin, aliphatic or alicyclic hydrocarbon resin, aromatic petroleum resin, chlorinated paraffin, and paraffin wax. Out of the above compositions, the polyester resin is especially preferred to be used to obtain the sufficient fixability. The polyester resin is obtained by a condensation polymerization of alcohol and carboxylic acid. As the alcohol to be used, for example, there are diols such as polyethylene glycol, diethylene glycol, triethylene glycol, 1,2-propylene glycol, 1,3-propylene glycol, 1,4-butanediol, neopentylglycol, and 1,4-butenediol; bisphenol ethers such as 1,4-bis(hydroxymethyl)cyclohexane, bisphenol A, hydrogenated bisphenol A, polyoxyethylene bisphenol A ether, and polyoxypropylene bisphenol A ether, a diol alone in which the above alcohol is replaced by a saturated or an unsaturated hydrocarbon group having a carbon number of 3 to 22, and other diol alone.

As the carboxylic acid used to obtain the polyester resin, for example, there are maleic acid, fumaric acid, mesaconic acid, citraconic acid, itaconic acid, glutaconic acid, phthalic acid, isophthalic acid, terephthalic acid, cyclohexane dicarboxylic acid, succinic acid, adipic acid, sebacic acid, and malonic acid, a dihydric organic acid monomer in which the above acids are replaced by a saturated or an unsaturated hydrocarbon group having a carbon number of 3 to 22, acid anhydrides of the above acids, a dimer of lower alkyl ester and linoleic acid, and other dihydric organic acid monomers.

To obtain the polyester resin used as the binder resin, it is preferable to use not only polymer consisting of the above bifunctional monomers but also polymer containing components formed by polyfunctional monomers, at least trifunctional monomers. As a polyhydric alcohol monomer, at least a trihydric alcohol monomer, as the polyfunctional monomer, for example, there are sorbitol, 1,2,3,6-hexane tetrolol, sorbitan, saccharose, 1,2,4-butane triol, 1,2,5-pentane triol, glycerol, 2-methylpropane triol, 2-methyl-1,2,4-butane triol, trimethylol ethane, trimethylol propane, and 1,3,5-trihydroxymethylbenzen.

As a polyfunctional carboxylic acid monomer, at least a trifunctional carboxylic acid monomer, for example, there are 1,2,4-benzentricarboxylic acid, 1,2,5-benzentricarboxylic acid, 1,2,4-cyclohexanetricarboxylic acid, 2,5,7-naphthalenetricarboxylic acid, 1,2,4-naphthalenetricarboxylic acid, 1,2, 4-butanetricarboxylic acid, 1,2,5-hexanetricarboxylic acid, 1,3-dicarboxyl-2-methyl-2-methylenecarboxypropane, tetra (methylene carboxyl) methane, octane tetracarboxylic acid, empol trimeric acid, acid anhydrides of the above acids, and the like.

A mold release agent can be contained in the toner according to the present invention to improve a releasability of the toner on a surface of a fixing belt at the time of fixing. Any of well-known mold release agents can be used, but preferably, free fatty acid-free carnauba wax, montan wax, oxidized rice wax, and ester wax can be used independently or in combination. As the carnauba wax, it is preferable to use microcrystalline carnauba wax having an acid number of 5 or less and a particle diameter of 1 μm or less while dispersed in the toner binder. The montan wax generally indicates the one refined from a mineral substance. As the montan wax, in the same manner as the carnauba wax, it is preferable to use a microcrystalline montan wax having an acid number of 5 to 14. The oxidized rice wax is the one that a rice bran wax is oxidized by air, and an acid number of the oxidized rice wax is preferred to be in a range of 10 to 30. If each of the waxes has the acid number lower than each of the ranges, the low-temperature fixability is insufficient due to an increase of a low-temperature fixing temperature. On the other hand, if each of the waxes has the acid number exceeding each of the ranges, the low-temperature fixability is insufficient due to an increase of a cold offset temperature. An amount of the wax to be added is in a range of 1 to 15 parts by weight with respect to 100 parts by weight of the binder resin, and preferably in a range of 3 to 10 parts by weight. If the amount is below 1 part by weight, the mold releasing effect of the wax is insufficient, so that it is difficult to obtain a desired effect. On the other hand, if the amount exceeds 15 parts by weight, there is such a problem that a toner spent to a carrier occurs significantly.

Moreover, a charge controlling agent can be contained in the toner to impart a charge to the toner. Any of well-known conventional charge controlling agents can be used. As a positive charge controlling agent, there are nigrosin, basic dye, lake pigment of the basic dye, quaternary ammonium salt compound, and the like. As a negative charge controlling agent, there are metal salt of monoazo dye, metal complex of salicylic acid, naphthoic acid, or dicarboxylic acid, and the like. An amount of the polarity controlling agent to be used is determined depending on a type of the binder resin, with or without an additive agent used on an as-needed basis, and a method of manufacturing the toner including a dispersing method. The amount of the polarity controlling agent is not unambiguously determined, but to be in a range of 0.01 to 8 parts by weight with respect to 100 parts by weight of the binder resin, and preferably in a range of 0.1 to 2 parts by weight. If the amount is below 0.01 part by weight, an effect of the polarity controlling agent on a fluctuation in a charge amount Q/M due to an environmental fluctuation is small. On the other hand, if the amount exceeds 8 parts by weight, the low-temperature fixability results in insufficient.

As the metal-containing monoazo dye to be used, chromium-containing monoazo dye, cobalt-containing monoazo dye, and iron-containing monoazo dye can be used independently or in combination. By adding such the monoazo dye, a rising edge of the charge amount Q/M in a developer (a time to the saturation) can be improved. An amount of the metal-containing monoazo dye to be used is determined, in the same manner as the polarity controlling agent, depending on a type of the binder resin, with or without an additive agent used on an as-needed basis, and a method of manufacturing the toner including a dispersing method. The amount of the metal-containing monoazo dye is not unambiguously determined, but to be in a range of 0.1 to 10 parts by weight with respect to 100 parts by weight of the binder resin, and preferably in a range of 1 to 7 parts by weight. If the amount is below 0.1 part by weight, an effect of the metal-containing monoazo dye is insufficient. On the other hand, if the amount exceeds 10 parts by weight, there is such a problem that a saturation level of the charge amount decreases.

Furthermore, for the color toner, the metal salt of the salicylic acid derivative is particularly preferred to be used; however, a transparent substance or a substance in white, which does not interfere with a color tone of the color toner, can be added if needed to stabilize the toner charging. Concretely, organoboron salt, fluorine-containing quaternized ammonium salt, calyx allene compound, or the like are used, but not limited thereto.

Furthermore, a magnetic material can be contained in the toner according to the present invention to be used as a magnetic toner. As the magnetic material to be contained in the magnetic toner according to the present invention, there are iron oxide such as magnetite, hematite, and ferrite, metal such as iron, cobalt, and nickel, aluminum alloy of the metal, metal alloy such as the cobalt, copper, lead, magnesium, tin, zinc, antimony, beryllium, bismuth, cadmium, calcium, manganese, selenium, titanium, tungsten, and vanadium, a mixture of the metal alloy, and the like.

An average particle diameter of the above ferromagnetic material is preferred to be in a range of about 0.1 μm to 2 μm, and an amount of the ferromagnetic material to be contained in the toner is in a range of about 20 to 200 parts by weight with respect to 100 parts by weight of the resin component, and preferably in a range of 40 to 150 parts by weight with respect to 100 parts by weight of the resin component.

As a colorant, any of well-known toner colorants can be used. For example, as a black colorant, there are a black colorant such as carbon black, anylyne black, furnace black, lampblack; a cyan colorant such as phthalocyanine blue, methylene blue, victoria blue, methyl violet, aniline blue, ultramarine blue; a magenta colorant such as rhodamine 6G lake, dimethylquinacridone, watching red, rose bengal, rhodamine B, alizarin lake; a yellow colorant such as chrome yellow, benzidine yellow, hansa yellow, naphthol yellow, molybdate orange, quinoline yellow, tartrazine, can be used. As the colorant used in the toner according to the present invention, any of dyes and pigments capable of obtaining any of yellow, magenta, cyan, and black toners can be used. For example, well-known conventional dyes and pigments, such as carbon black, lampblack, ultramarine blue, anylyne blue, phthalocyanine blue, phthalocyanine green, hansa yellow G, rhodamine 6G lake, calco oil blue, chrome yellow, quinacridone, benzidine yellow, rose bengal, and triarylmethane pigment, can be used independently or by mixture.

Furthermore, to improve the flowability of the toner, as an external additive agent, for example, hydrophobic silica, titanium oxide, or alumina can be added to the toner, and also fatty-acid metal salt or polyvinylidene fluoride can be further added to the toner if needed.

Furthermore, when the toner according to the present invention is used as a two-component developer, as an available carrier to be used, any of well-known carriers can be used. For example, there are a magnetic powder such as an iron powder, a ferrite powder, and a nickel powder, a glass bead, and any of the above carriers which surface is coated with a resin.

As an available resin powder to be used for coating the carrier according to the present invention, there are styrene-acrylic copolymer, silicone resin, maleic acid resin, fluorine resin, polyester resin, epoxy resin, and the like. In a case of the styrene-acrylic copolymer, it is preferable to use the styrene-acrylic copolymer in which a content of styrene is in a range of 30% to 90% by weight. If the content of the styrene is below 30% by weight, the developing performance is insufficiently low. On the other hand, if the content of the styrene exceeds 90% by weight, a coating film is hardened, so that the resin powder is easily come off from the carrier, and thereby shortening a life of the carrier. The resin powder used for coating the carrier according to the present invention can contain an adhesive agent, a hardening agent, a lubricant, a conducting material, a charge controlling agent, and the like in addition to the above resin.

As a carrier nucleus particle coated with the silicone resin in the present invention, any of well-known conventional carrier nucleus particles can be used. For example, ferromagnetic metal such as iron, cobalt, and nickel; alloy or a compound such as magnetite, hematite, and ferrite; and a glass bead can be used as the carrier nucleus particle. An average particle diameter of the nucleus particles is generally in a range of 10 μm to 1000 μm, and preferably in a range of 30 μm to 500 μm. A rate of an amount of the silicone resin to be used is generally in a range of 1% to 10% by weight with respect to the carrier nucleus particle.

As the silicone resin used in the present invention, any of well-known conventional silicone resins can be used. For example, there can be used commercially available silicone resins, such as KR261, KR271, KR272, KR275, KR280, KR282, KR285, KR251, KR155, KR220, KR201, KR204, KR205, KR206, SA-4, ES1001, ES100N, ES1002T, and KR3093 those manufactured by Shin-Etsu Silicones Co., Ltd., SR2100, SR2101, SR2107, SR2110, SR2108, SR2109, SR2115, SR2400, SR2410, SR2411, SH805, SH806A, and SH840 those manufactured by Toray Silicone Co., Ltd. As a method of forming a silicone resin layer, the silicone resin is applied to a surface of the carrier nucleus particle with a conventionally used method such as an atomizing method or a dipping method.

The toner preferred to be used in the image forming apparatus according to the present invention is obtained in such a manner that a toner material solution, which is an organic solvent in which at least polyester prepolymer having a functional group including nitrogen atom, polyester, a colorant, and a mold release agent are dispersed, is reacted to be crosslinked and/or elongated in a waterborne solvent. Constituent materials of the toner and a method of manufacturing the toner are explained below.

Polyester is obtained by polycondensation reaction polyhydric alcohol compounds and polycarboxylic acid compounds. Examples of polyhydric alcohol compound (PO) include dihydric alcohol (DIO) and trivalent or more polyhydric alcohols (TO); and (DIO) alone or a mixture of (DIO) with a small amount of (TO) is preferable. Examples of dihydric alcohol (DIO) include alkylene glycol (e.g., ethylene glycol, 1,2-propylene glycol, 1,3-propylene glycol, 1,4-butanediol, and 1,6-hexanediol); alkylene ether glycols (e.g., diethylene glycol, triethylene glycol, dipropylene glycol, polyethylene glycol, polypropylene glycol, and polytetramethylene ether glycol); alicyclic diols (e.g., 1,4-cyclohexane dimethanol, and hydrogenated bisphenol A); bisphenols (e.g., bisphenol A, bisphenol F, and bisphenol S); adducts of alkylene oxide of the alicyclic diols (e.g., ethylene oxide, propylene oxide, and butylene oxide); and adducts of alkylene oxide of the bisphenols (e.g., ethylene oxide, propylene oxide, and butylene oxide). Among these, alkylene glycol having a carbon number from 2 to 12 and the adducts of alkylene oxides of the bisphenols are preferable. Particularly preferable are the adducts of alkylene oxides of the bisphenols, and a combination of the adducts of alkylene oxides of the bisphenols and alkylene glycol having a carbon number from 2 to 12. Trivalent or more polyhydric alcohols (TO) include trihydric to octahydric alcohols and more aliphatic alcohols (e.g., glycerol, trimethylolethane, trimethylolpropane, pentaerythritol, and sorbitol); trivalent or more phenols (e.g., trisphenol PA, phenol novolak, and cresol novolak); and adducts of alkylene oxides of the trivalent or more polyphenols.

Examples of the polycarboxylic acid (PC) include dicarboxylic acid (DIC) and trivalent or more carboxylic acid (TC); (DIC) alone and a mixture of (DIC) with a small amount of (TC) is preferable. Examples of dicarboxylic acids (DIC) include alkylene dicarboxylic acids (e.g., succinic acid, adipic acid, and sebacic acid); alkenylene dicarboxylic acids (e.g., maleic acid and fumaric acid); and aromatic dicarboxylic acids (e.g., phthalic acid, isophthalic acid, terephthalic acid, and naphthalene dicarboxylic acid). Among these, the alkenylene dicarboxylic acids having a carbon number from 4 to 20 and the aromatic dicarboxylic acids having a carbon number from 8 to 20 are preferred. Examples of trivalent or more carboxylic acids (TC) include aromatic polycarboxylic acids having a carbon number from 9 to 20 (e.g., trimellitic acid and pyromellitic acid). The polycarboxylic acid (PC) may be reacted with polyhydric alcohol compounds (PO) using acid anhydrides of these or lower alkyl esters (e.g., methyl ester, ethyl ester, and isopropyl ester).

A ratio between the polyhydric alcohol compounds (PO) and the polycarboxylic acid (PC) is usually from 2/1 to 1/1, preferably from 1.5/1 to 1/1, more preferably from 1.3/1 to 1.02/1, as an equivalent ratio of [OH]/[COOH] between a hydroxyl group [OH] and a carboxyl group [COOH].

For polycondensation reaction, under presence of an esterification catalyst, such as tetrabutoxy titanate or dibutyltin oxide, the polyhydric alcohol (PO) and a polycarboxylic acid (PC) are heated to between 150° C. and 280° C., the pressure is reduced as required, and produced water is removed, so that a polyester having a hydroxyl group is obtained. The number of hydroxyl groups of the polyester is preferred to 5 or more. An acid number of the polyester is generally in a range of 1 to 30, and preferably in a range of 5 to 20. With the acid number, the polyester is prone to a negative electric charge, and it is possible to obtain an excellent affinity of the toner for a recording medium at the time of fixing on the recording medium, and to improve the low-temperature fixability. However, if the acid number exceeds 30, there is a tendency to lower the charge stability, especially with respect to an environmental fluctuation.

A weight-average molecular weight is in a range of 10000 to 400000, and preferably in a range of 20000 to 200000. If the weight-average molecular weight is below 10000, the anti-offset performance unpreferably gets worse. On the other hand, if the weight-average molecular weight exceeds 400000, the low-temperature fixability unpreferably gets worse.

The polyesters include unmodified polyester obtained from the polycondensation, and moreover, preferably a urea modified polyester. The urea modified polyester is obtained as follows: a carboxyl group or a hydroxyl group at an end of a polyester obtained by the polycondensation, and a polyisocyanate compound (PIC) are exposed to reaction; a polyester prepolymer (A) having an isocyanate group is obtained; the obtained polyester prepolymer (A) and amines are exposed to reaction so that molecular chains are crosslinked and/or elongated.

Examples of polyisocyanate compounds (PIC) are aliphatic polyisocyanates (e.g., tetramethylene diisocyanate, hexamethylene diisocyanate, and 2,6-diisocyanate methyl caproate); alicyclic polyisocyanates (e.g., isophorone diisocyanate and cyclohexylmethane diisocyanate); aromatic diisocyanates (e.g., tolylene diisocyanate and diphenylmethane diisocyanate); aromatic aliphatic diisocyanates (e.g., α,α,α',α'-tetramethylxylylene diisocyanate); isocyanates; compounds formed by blocking these polyisocyanates by a phenol derivative, an oxime, and a caprolactam; and a combination of at least two of these.

A ratio of the polyisocyanate compounds (PIC) is usually from 5/1 to 1/1, preferably from 4/1 to 1.2/1, and more preferably from 2.5/1 to 1.5/1, as an equivalent ratio of [NCO]/[OH] between an isocyanate group [NCO] and a hydroxyl group [OH] of a hydroxyl group-containing polyester. When [NCO]/[OH] exceeds 5, the low-temperature fixing property gets worse. In a case of using urea-modified polyester, the urea content in the ester becomes low when a molar ratio of [NCO] is less than 1, and hot offset resistance deteriorates.

The content of the polyisocyanate (PIC) in the isocyanate group-containing polyester prepolymer (A) ranges usually from 0.5 wt % to 40 wt %, preferably from 1 wt % to 30 wt %, and more preferably from 2 wt % to 20 wt %. If the content of the polyisocyanate compound is less than 0.5 wt %, the hot offset resistance deteriorates, and it is unfavorable from the viewpoint of compatibility of heat resistant preservability and low-temperature fixing property. On the other hand, if the content of the polyisocyanate compound exceeds 40 wt %, the low-temperature fixing property gets worse.

The number of isocyanate groups contained in one molecule of the isocyanate group-containing polyester prepolymer (A) is usually at least 1, preferably, an average of 1.5 to 3, and more preferably, an average of 1.8 to 2.5. If the isocyanate group per molecule is less than 1, then the molecular weight of the urea-modified polyester becomes low and the hot offset resistance deteriorates.

Further, amines (B) that are reacted with the polyester prepolymer (A) include diamine compounds (B1), trivalent or more polyamine compounds (B2), amino alcohols (B3), amino mercaptans (B4), amino acids (B5), and the compounds (B6) of B1 to B5 in which their amino groups are blocked.

Examples of the diamine compounds (B1) include aromatic diamines (e.g., phenylene diamine, diethyl toluene diamine, and 4,4'-diaminodiphenyl methane); alicyclic diamines (e.g., 4,4'-diamino-3,3'-dimethyldicyclohexylmethane, diamine cyclohexane, and isophorone diamine); and aliphatic diamines (e.g., ethylene diamine, tetramethylene diamine, and hexamethylene diamine).

Examples of the trivalent or more amine compounds (B2) include diethylene triamine and triethylene tetramine. Examples of the amino alcohols (B3) include ethanolamine and hydroxyethylaniline. Examples of the amino mercaptans (B4) include aminoethyl mercaptan and aminopropyl mercaptan. Examples of the amino acids (B5) include aminopropionic acid and aminocaproic acid. Examples of the compounds (B6), in which the amino groups of B1 to B5 are blocked, include ketimine compounds obtained from the amines of B1 to B5 and ketones (e.g., acetone, methyl ethyl ketone, and methyl isobutyl ketone), and oxazolidine compounds. The preferable amines among the amines (B) are B1 and a mixture of B1 with a small amount of B2.

A ratio of amines (B) is usually 1/2 to 2/1, preferably 1.5/1 to 1/1.5, and more preferably 1.2/1 to 1/1.2 as an equivalent ratio of [NCO]/[NHx] between an isocyanate group [NCO] in the isocyanate group-containing polyester prepolymer (A) and an amine group [NHx] in the amines (B). When [NCO]/[NHx] exceeds 2 or is less than ½, the molecular weight of the urea-modified polyester (i) becomes smaller, resulting in deterioration in hot offset resistance.

An urethane bond may be contained together with an urea bond in the urea-modified polyester. A molar ratio of the urea bond content and the urethane bond content ranges usually from 100/0 to 10/90, preferably from 80/20 to 20/80, and more preferably from 60/40 to 30/70. If the molar ratio of the urea bond is less than 10%, the hot offset resistance deteriorates.

The urea-modified polyester is manufactured by a one shot method, or the like. Polyhydric alcohol compounds (PO) and polycarboxylic acid (PC) is heated to 150° C. to 280° C. in the presence of a known esterification catalyst such as tetrabutoxytitanate and dibutyltin oxide, and by distilling water generated while pressure is reduced if required, and polyester having the hydroxyl group is obtained. Polyisocyanate (PIC) is reacted with the polyester at a temperature of 40° C. to 140° C. to obtain isocyanate group-containing polyester prepolymer (A). The amine group (B) is further reacted with (A) at the temperature of 0° C. to 140° C. to obtain the urea-modified polyester.

When (PIC) is reacted or (A) and (B) are reacted, a solvent can be used if necessary. Examples of available solvent include those inactive to isocyanate, such as an aromatic solvent (e.g., toluene, and xylene); ketone group (e.g., acetone, methyl ethyl ketone, and methyl isobutyl ketone); ester group (e.g., ethyl acetate); amide group (e.g., dimethylformamide, and dimethylacetoamide); and ether group (e.g., tetrahydrofuran).

A reaction inhibitor is used as required for crosslinking reaction between polyester prepolymer (A) and amines (B) and/or elongation reaction, thereby adjusting the molecular weight of the urea-modified polyester obtained. Examples of the reaction inhibitor include monoamines (e.g., diethylamine, dibutylamine, butylamine, and laurylamine), and compounds (ketimine compounds) in which the monoamines are blocked.

The weight-average molecular weight of the urea-modified polyester is usually not less than 10,000, preferably 20,000 to 10,000,000, and more preferably 30,000 to 1,000,000. If the weight-average molecular weight is less than 10,000, the hot offset resistance deteriorates. A number-average molecular weight of the urea-modified polyester is not particularly limited when the unmodified polyester is used, and the number-average molecular weight should be one which is easily obtained to get a weight-average molecular weight. When the urea-modified polyester is used alone, the number-average molecular weight is usually 20,000 or less, preferably 1,000 to 10,000, and more preferably 2,000 to 8,000. When the number-average molecular weight exceeds 20,000, the low-temperature fixing property deteriorates and the glossiness also deteriorates when used for full-color apparatus.

By using the urea-modified polyester in combination with the unmodified polyester, the low-temperature fixing property is improved and the glossiness is also improved when used for full-color apparatus 100, which is more preferable than a single use of the urea-modified polyester. The unmodified polyester may include the modified polyester through a chemical bond other than an urea bond. It is preferable that at least parts of the urea-modified polyester and the unmodified polyester are compatible with each other, from viewpoint of low-temperature fixing property and hot offset resistance. Therefore, polyester components of the urea-modified polyester and the unmodified polyester have preferably similar compositions.

Moreover, a weight ratio between the urea-modified polyester and the unmodified polyester is usually 20/80 to 95/5, preferably 70/30 to 95/5, more preferably 75/25 to 95/5, and particularly preferably 80/20 to 93/7. When the weight ratio of the urea-modified polyester is less than 5%, the hot offset resistance deteriorates, and this becomes disadvantageous in respect of compatibility between heat resistant preservability and low-temperature fixing property.

A glass transition point (Tg) of binder resin containing the urea-modified polyester and the unmodified polyester is usually from 45° C. to 65° C., and preferably from 45° C. to 60° C. If Tg is less than 45° C., blocking when toner is stored under high temperature deteriorates, while if Tg exceeds 65° C., the low temperature fixing property becomes insufficient.

Under coexistence with urea-modified polyester resin, the dry toner tends to show better heat resistant preservability as compared with known polyester toner, even if the glass transition point is low.

All known dyes and pigments are available for a colorant, and the followings and mixtures thereof can be used: for example, carbon black, nigrosine dyes, iron black, naphthol yellow S, Hansa yellow (10G, 5G, G), cadmium yellow, yellow iron oxide, yellow ocher, chrome yellow, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazine lake, quinoline yellow lake, anthrazane yellow BGL, isoindolinone yellow, red iron oxide, minium, red lead, cadmium red, cadmium mercury red, antimony vermilion, permanent red 4R, para red, fire red, parachloro-ortho-nitroaniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmine 6B, pigment scarlet 3B, bordeaux 5B, toluidine maroon, permanent bordeaux F2K, helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chrome oxide, pyridian, emerald green, pigment green B, naphthol green B, green gold, acid green lake, malachite green lake, phthalocyanine green, anthraquinone green, titanium oxide, zinc white, and lithopone. The content of the colorant is usually 1 weight % to 15 weight %, and preferably 3 weight % to 10 weight % in toner particles.

The colorant can also be used as a master batch mixed with resin. Examples of binder resin used to manufacture such a master batch or to be kneaded with the master batch include styrenes such as polystyrene, poly-p-chlorostyrene, polyvinyltoluene, and substituted polymer thereof, or copolymer of these compounds and vinyl compounds, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylate resin, rosin, modified rosin, terpene resin, aliphatic or alicyclic hydrocarbon resin, aromatic petroleum resin, chlorinated paraffin, and paraffin wax. These materials can be used alone or as a mixture thereof.

Known charge control agents can be used as a charge control agent, and include, for example, nigrosine dyes, triphenylmethane dyes, chromium-containing metal complex dyes, chelate molybdate pigment, rhodamine dyes, alkoxy amine, quaternary ammonium salt (including fluorine modified quaternary ammonium salt), alkylamide, phosphorus alone or compounds thereof, tungsten alone or compounds thereof, fluorine-based active agents, salicylic acid metal salts, and metal salts of salicylic acid derivatives. More specific examples of the charge control agents are Bontron 03 as nigrosine dyes, Bontron P-51 as quaternary ammonium salts, Bontron S-34 as metal-containing azo dyes, E-82 as oxynaphthoic acid type metal complex, E-84 as salicylic acid metal complex, E-89 as phenol type condensate (these are manufactured by Orient Chemical Industries, Ltd.), TP-302 and TP-415 as quaternary ammonium salt molybdenum complexes (manufactured by Hodogaya Chemical Industries, Ltd.), Copy Charge PSY VP2038 as quaternary ammonium-salt and Copy Charge NX VP434 as quaternary ammonium salt (these are manufactured by Hoechst Co., Ltd.), LRA-901 and LR-147 as boron complex (manufactured by Japan Carlit Co., Ltd.), copper phthalocyanine, perylene, quinacridone, azo type pigments, and polymer compounds having a functional group such as a sulfonic acid group, a carboxyl group, and a quaternary ammonium salt group. Among these, a material that controls the toner to have negative polarity is preferably used.

The use amount of the charge control agent is determined depending on the type of binder resins, presence or absence of additives to be used as required, and a method of manufacturing toner including a dispersion method, and hence, it is not uniquely limited. However, the charge control agent is used preferably in a range from 0.1 to 10 parts by weight, and more preferably from 0.2 to 5 parts by weight, per 100 parts by weight of the binder resin. If it exceeds 10 parts by weight, the toner is charged too highly, which causes effects of the charge control agent to be decreased, electrostatic attracting force with a developing roller to be increased, fluidity of the developer to be lowered, and image density to be reduced.

A wax having a low melting point in a range from 50° C. to 120° C. effectively functions as a release agent between a fixing roller and a toner boundary in dispersion with binder resin. Due to this effective functioning of the wax, there is no need to apply a release agent as oil to the fixing roller and the high temperature offset is improved. Such wax components include the followings. Examples of waxes include waxes from plants such as carnauba wax, cotton wax, wood wax, and rice wax; waxes from animals such as beeswax and lanolin; waxes from mineral substances such as ozokerite and cercine; and petroleum waxes such as paraffin, microcrystalline, and petrolatum. Examples of waxes apart from these natural waxes include synthetic hydrocarbon waxes such as Fischer-Tropsch wax and polyethylene wax; and synthetic waxes such as ester, ketone, and ether. In addition to these, a crystalline polymer of which side chain has long alkyl group can be also used. The crystalline polymer includes homo polymer or copolymer of polyacrylate such as poly-n-stearyl methacrylate and poly-n-lauryl methacrylate (for example, n-stearyl acrylate-ethyl methacrylate copolymer), which are aliphatic amide such as 12-hydroxy stearamide, stearic acid amide, phthalic anhydride imide, and chlorinated hydrocarbon; and crystalline polymer resin having low molecular weight.

The charge control agent and the release agent can be fused and mixed with the master batch and the binder resin, and may be added to organic solvent at a time of dissolution and dispersion.

Inorganic fine particles are preferably used as an external additive to facilitate fluidity, developing performance, and chargeability of toner particles. The inorganic fine particle has preferably a primary particle diameter of $5\times10^{-3}$ to 2 micrometers. In particular, the primary particle diameter is preferably $5\times10^{-3}$ to 0.5 micrometer. A specific surface area by the BET method is preferably 20 to 500 $m^2/g$. The use ratio of the inorganic fine particles is preferably 0.01 wt % to 5 wt % in toner particles, and more preferably 0.01 wt % to 2.0 wt %.

Specific examples of the inorganic particles include silica, alumina, titanium oxide, barium titanate, magnesium titanate, calcium titanate, strontium titanate, zinc oxide, tin oxide, silica sand, clay, mica, wollastonite, diatomite, chromium oxide, cerium oxide, red iron oxide, antimony trioxide, magnesium oxide, zirconium oxide, barium sulfate, barium carbonate, calcium carbonate, silicon carbide, and silicon nitride. Among these materials, hydrophobic silica particles and hydrophobic titanium oxide particles are preferably used in combination as a fluidizing agent. In particular, when both particles having an average diameter of $5\times10^{-2}$ micrometers or less are mixed, electrostatic force and Van der Waals force with toner particles are significantly improved. As a result, even if such external additives are mixed with toner particles in a developing device to achieve a desired charge level, "firefly" (spot)-free desirable image quality can be obtained without desorption of the fluidizing agent from toner particles, and further an amount of remaining toner after a toner image is transferred can be reduced.

While titanium oxide fine particles are excellent in environmental stability and image density stability, the titanium oxide fine particles tend to exhibit degradation in charge rising property. As a result, if an addition amount of titanium oxide fine particles is more than that of silica fine particles, this adverse effect becomes more influential. However, if hydrophobic silica particles and hydrophobic titanium oxide particles are added within 0.3 wt % to 1.5 wt %, desired charge rising property is obtained without significant damage to the charge rising property. In other words, even if an image is repeatedly copied, stable image quality can be obtained.

A toner manufacturing method is explained below. Here, exemplary embodiments of the toner manufacturing method are explained below, but the present invention is not limited to these embodiments.

1) Toner material solution is produced by dispersing a colorant, an unmodified polyester, an isocyanate group-containing polyester prepolymer, and a release agent in organic solvent. From the viewpoint of easy removal after formation of toner base particles, it is preferable that the organic solvent be volatile and have a boiling point of less than 100° C. More specifically, the followings can be used solely or in combination with two or more types thereof, such as toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. In particular, aromatic solvent such as toluene and xylene, and halogenated hydrocarbon such as methylene chloride, 1,2-dichloroethane, chloroform, and carbon tetrachloride are preferred. The use amount of organic solvent is usually 0 to 300 parts by weight for 100 parts by weight of polyester prepolymer, preferably 0 to 100 parts by weight, and further preferably 25 to 70 parts by weight.

2) The toner material solution is emulsified in aqueous medium in the presence of a surfactant and resin fine particles. Such aqueous medium may be water alone or contain organic solvent such as alcohol (e.g. methanol, isopropyl alcohol, and ethylene glycol), dimethyl formamide, tetrahydrofuran, cellosolves (e.g. methyl cellosolve), and lower ketones (e.g. acetone, methylethylketone). The use amount of the aqueous medium for 100 parts by weight of the toner material solution is usually 50 to 2,000 parts by weight, and preferably 100 to 1,000 parts by weight. If the amount is less than 50 parts by weight, the toner material solution is poorly dispersed, and it is thereby impossible to obtain toner particles having a predetermined particle size. If the amount exceeds 20,000 parts by weight, this is economically inefficient.

Further, to improve the dispersion in the aqueous medium, a dispersing agent such as a surfactant and resin fine particles are added as required. Examples of the surfactant are anionic surfactants such as alkyl benzene sulfonate, α-olefin sulfonate, and ester phosphate; amine salts such as alkyl amine salts, aminoalcohol fatty acid derivatives, polyamine fatty acid derivatives, and imidazoline; cationic surfactants of quaternary ammonium salt types such as alkyl trimethyl ammonium salts, dialkyl dimethyl ammonium salts, alkyl dimethyl benzyl ammonium salts, pyridinium salts, alkyl isoquinolinium salts, and benzethonium chloride; nonionic surfactants such as fatty acid amide derivatives and polyhydric alcohol derivatives; and ampholytic surfactants such as alanine, dodecyl di(aminoethyl)glycine, di(octylaminoethyl)glycine, N-alkyl-N, and N-dimethyl ammonium betaine.

Furthermore, a surfactant having a fluoroalkyl group is used to achieve a desired effect with a very small amount thereof. Preferable examples of anionic surfactants having a fluoroalkyl group are fluoroalkyl carboxylic acids having a carbon number from 2 to 10 and their metal salts; disodium perfluorooctane sulfonyl glutamate, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propane sulfonate, fluoroalkyl (C11 to C20) carboxylic acid and its metal salts; perfluoroalkyl carboxylic acid (C7 to C13) and its metal salts; perfluoroalkyl (C4 to C12) sulfonic acid and its metal salts, perfluorooctane sulfonic acid diethanolamide, N-propyl-N-(2-hydroxyethyl) perfluorooctane sulfonamide, perfluoroalkyl (C6 to C10) sulfonamide propyl trimethyl ammonium salts, perfluoroalkyl (C6 to C10)-N-ethylsulfonyl glycine salts, monoperfluoroalkyl (C6 to C16) ethyl phosphoric acid esters.

Examples of trade names are SURFLON S-111, S-112, and S113 (manufactured by Asahi Glass Co., Ltd.), FLUORAD FC-93, FC-95, FC-98, and FC-129 (manufactured by Sumitomo 3M Co., Ltd.), UNIDINE DS-101 and DS-102 (manufactured by Daikin Industries, Ltd.), MEGAFACE F-110, F-120, F-113, F-191, F-812, and F-833 (manufactured by Dainippon Ink & Chemicals, Inc.), EKTOP EF-102, 103, 104, 105, 112, 123A, 123B, 306A, 501, 201, and 204 (manufactured by Tochem Products Co., Ltd.), and FTERGENT F-100 and F150 (manufactured by Neos Co., Ltd.).

Examples of cationic surfactants are aliphatic primary, secondary, or tertiary amine containing a fluoroalkyl group, aliphatic quaternary ammonium salt such as ammonium salt of perfluoroalkyl (C6-C10) sulfonamide propyl trimethyl; benzalkonium salts, benzethonium chloride, pyridinium salts, and imidazolinium salts. Trade names thereof are SURFLON S-121 (manufactured by Asahi Glass Co., Ltd.), FLUORAD FC-135 (manufactured by Sumitomo 3M Co., Ltd.), UNIDYNE DS-202 (manufactured by Daikin Industries, Ltd.), MEGAFACE F-150 and F-824 (manufactured by Dainippon Ink & Chemicals, Inc.), EKTOP EF-132 (manufactured by Tochem Products Co., Ltd.), and FTERGENT F-300 (manufactured by Neos Co., Ltd.), or the like.

The resin particles are added for stabilizing the parent toner particles that are formed in the aqueous solvent. To stabilize the parent toner particles, the resin particles are desirably added such that a surface coverage of the resin particles on the surface of the parent toner particles is in a range of 10 to 90 percent. Examples of the resin particles are methyl poly-methacrylate particles of 1 (μm) and 3 (μm), polystyrene particles of 0.5 (μm) and 2 (μm), poly (styrene-acrylonitrile) particles of 1 (μm) etc. Examples of product names are PB-200H (manufactured by Kao Company), SGP (manufactured by Soken Company), technopolymer-SB (manufactured by Sekisui Plastics Company), SGP-3G (manufactured by Soken Company), micropearl (manufactured by Sekisui Fine Chemicals Company) etc. Further, inorganic compound dispersing agents such as tricalcium phosphate, calcium carbonate, titanium oxide, colloidal silica, hydroxyapatite etc. can also be used.

Dispersion droplets may be stabilized by a high polymer protective colloid as a dispersing agent usable in combination with the resin fine particles and the inorganic dispersing agent. Examples are acids such as acrylic acid, methacrylic acid, α-cyanoacrylic acid, α-cyanomethacrylic acid, itaconic acid, crotonic acid, fumaric acid, maleic acid, or maleic anhydride; or methacrylic monomers containing a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol ester monoacrylate, diethylene glycol ester monomethacrylate, glycerol ester monoacrylate, glycerol ester monomethacrylate, N-methylol acrylamide, N-methylol methacrylamide; vinyl alcohol or ethers with vinyl alcohol such as vinyl methyl ether, vinyl ethyl ether, vinyl propyl ether; or esters of compounds that contains a vinyl alcohol and a carboxyl group such as vinyl acetate, vinyl propionate, vinyl butyrate; acrylamide, methacrylamide, diacetone acrylamide or their methylol compounds; acid chlorides such as chloride acrylate and chloride methacrylate; homopolymers or copolymers of nitrogen-containing compounds such as vinylpyridine, vinylpyrrolidone, vinylimidazole, and ethyleneimine, or of heterocyclic ring thereof; polyoxyethylene compounds such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, and polyoxyethylene nonyl phenyl ester; and a cellulose group such as methyl cellulose, hydroxyethyl cellulose, and hydroxypropyl cellulose.

A dispersion method is not particularly limited, and it is possible to use known facilities of a low-speed shearing type, a high-speed shearing type, a friction type, a high-pressure jet type, and an ultrasonic type. Among these, the high-speed shearing type is preferred to obtain dispersed particles having a particle size ranging from 2 to 20 micrometers. When a high-speed shearing type dispersing machine is used, the number of revolutions is not particularly limited, and is usually from 1,000 rpm to 30,000 rpm, preferably from 5,000 rpm to 20,000 rpm. The dispersion time is not particularly limited and is usually from 0.1 to 5 minutes in a batch system. The dispersing temperature is usually from 0° C. to 150° C. (under a pressure), preferably from 40° C. to 98° C.

3) During preparation of an emulsified liquid, amines (B) are added and are allowed to react with polyester prepolymer (A) having an isocyanate group. This reaction is followed by crosslinking and/or elongation of a molecular chain. The reaction time is selected according to the reactivity between an isocyanate group structure of the polyester prepolymer (A) and amines (B), and is usually 10 minutes to 40 hours, preferably 2 hours to 24 hours. Moreover, a known catalyst can be used if necessary. Specific examples of the catalyst are dibutyltin laurate and dioctyltin laurate.

4) After completion of the reaction, the organic solvent is removed from emulsified dispersion (reaction compound), is washed, and dried to obtain the toner base particles. To remove the organic solvent therefrom, the whole system is gradually heated up while laminar flow is stirred, and is stirred vigorously at a fixed temperature range. The solvent is removed from the dispersion, and then spindle-shaped toner base particles are prepared. Further, if a compound like calcium phosphate salt that can dissolve in an acid or an alkali is used as a dispersion stabilizer, after the calcium phosphate salt is dissolved in an acid like hydrochloric acid, the calcium phosphate salt is removed from the toner base particles by a method of washing. In addition, the calcium phosphate salt can be removed through decomposition by an enzyme.

5) A charge control agent is implanted into the toner base particles thus obtained, and inorganic fine particles such as those of silica and titanium oxide are added externally to obtain the toner. The implantation of the charge control agent and the external addition of the inorganic fine particles are carried out by a known method using a mixer and so on. Accordingly, the toner having a small particle size and a sharp particle-size distribution can be obtained easily. Moreover, by vigorously stirring the toner in the process of removing the organic solvent, the shape of particles can be controlled in a range from a perfectly spherical shape to a spindle shape. Furthermore, the morphology of the surface can also be controlled in a range from a smooth shape to a rough shape.

According to an aspect of the present invention, by reducing an occurrence rate of a slipping between the charging roller and the cleaning roller, the cleaning effect on the surface of the charging roller is improved.

When a surface roughness of the charging roller (Rz) is 2.5 μm or less, it is possible not only to reduce the occurrence rate of the slipping between the rollers more effectively but also to ensure the excellent charge uniformity. When a dynamic friction coefficient of the charging roller is smaller than a dynamic friction coefficient of the cleaning roller, it is also possible to ensure the excellent charge uniformity. To ensure the excellent charge uniformity, it is effective that the cleaning roller is made of a melamine resin.

The invention claimed is:

1. A charging device comprising:

a charging roller; and a cleaning roller configured to make contact with the charging roller, wherein the cleaning roller is rotated following the charging roller, and a dynamic friction coefficient of a surface of the charging roller measured by a Euler belt method is equal to or larger than 0.5.

2. The charging device according to claim 1, wherein a pressure applied to the cleaning roller is larger than a weight of the cleaning roller and smaller than 4 newton.

3. The charging device according to claim 1, wherein a surface roughness of the charging roller is equal to or smaller than 2.5 micrometers.

4. The charging device according to claim 1, wherein a dynamic friction coefficient of the charging roller is smaller than a dynamic friction coefficient of the cleaning roller.

5. The charging device according to claim 1, wherein the cleaning roller is made of melamine resin.

6. A process cartridge comprising a charging device that includes a charging roller and a cleaning roller configured to make contact with the charging roller, wherein the cleaning roller is rotated following the charging roller, and a dynamic friction coefficient of a surface of the charging roller measured by a Euler belt method is equal to or larger than 0.5.

7. The process cartridge according to claim 6, wherein a weight-average particle diameter of a toner used in the process cartridge is 3 micrometers to 8 micrometers, and a ratio of the weight-average particle diameter to a number-average particle diameter of the toner is 1.00 to 1.40.

8. The process cartridge according to claim 6, wherein a toner used in the process cartridge has a shape factor SF-1 of 100 to 180, and a shape factor SF-2 of 100 to 180.

9. The process cartridge according to claim 6, wherein a microparticle having an average primary particle diameter of 50 nanometers to 500 nanometers and a bulk density of equal to or larger than 0.3 $mg/cm^3$ is externally added onto a surface of a toner base particle of a toner used in the process cartridge.

10. The process cartridge according to claim 6, wherein a toner used in the process cartridge contains at least binder resin, colorant, and mold release agent, a glass transition temperature of the toner is 45 degrees Celsius to 65 degrees Celsius, and an outflow start temperature of the toner is 90 degrees Celsius to 115 degrees Celsius.

11. The process cartridge according to claim 6, wherein a toner used in the process cartridge is obtained by causing a toner material solution, which is an organic solvent in which at least polyester prepolymer having a functional group including a nitrogen atom, polyester, colorant, and mold release agent are dispersed, to be reacted to be cross-linked or elongated or both in a waterborne solvent.

12. An image forming apparatus comprising a process cartridge including a charging device, wherein the charging device includes a charging roller and a cleaning roller configured to make contact with the charging roller, the cleaning roller is rotated following the charging roller, and a dynamic friction coefficient of a surface of the charging roller measured by a Euler belt method is equal to or larger than 0.5.

13. The image forming apparatus according to claim 12, further comprising a voltage applying unit that applies an alternate-current voltage biased with a direct-current voltage to the charging device.

14. A charging device comprising:

a charging roller; and a cleaning roller configured to make contact with the charging roller, wherein a condition expressed by an inequality $\mu_0 W x R_0 > \mu_1 W x R_1$ is satisfied where $\mu_1$ is a static friction coefficient between the charging roller and the cleaning roller, $\mu_1$ is a static friction coefficient between the cleaning roller and a bearing of the cleaning roller, W is a pressure including a weight of the cleaning roller, $R_1$ is a radius of the bearing, and $R_0$ is a radius of the cleaning roller.

* * * * *